US006018148A

United States Patent [19]

Wilkins

[11] Patent Number: 6,018,148

[45] Date of Patent: Jan. 25, 2000

[54] RADIANT ELECTRIC HEATER

[75] Inventor: Peter Ravenscroft Wilkins, Droitwich, United Kingdom

[73] Assignee: Ceramaspeed Limited, United Kingdom

[21] Appl. No.: 09/360,897

[22] Filed: Jul. 26, 1999

[30] Foreign Application Priority Data

Aug. 14, 1998 [GB] United Kingdom ..... 9817646

[51] Int. Cl.[7] ..... H05B 3/68

[52] U.S. Cl. ..... 219/461.1; 219/448.19

[58] Field of Search ..... 219/446.1, 448.11, 219/448.16, 448.19, 460.1, 461.1, 462.1

[56] References Cited

U.S. PATENT DOCUMENTS

| | | | |
|---|---|---|---|
| 5,270,519 | 12/1993 | Higgins | 219/448.19 |
| 5,453,597 | 9/1995 | McWilliams | 219/461.1 |
| 5,512,731 | 4/1996 | McWilliams | 219/461.1 |
| 5,796,075 | 8/1998 | Gross et al. | 219/461.1 |

FOREIGN PATENT DOCUMENTS

| | | |
|---|---|---|
| 0116861 | 8/1984 | Germany . |
| 2071969 | 9/1981 | United Kingdom . |

*Primary Examiner*—Sang Paik
*Attorney, Agent, or Firm*—Ira S. Dorman

[57] ABSTRACT

A radiant electric heater includes a base (2) of thermal and electrical insulation material having a surface supporting at least one heating element (3) in the form of an elongate electrically conductive ribbon (4). The ribbon (4) is supported on edge and is partially embedded in the surface of the base (2). A rod-like temperature-responsive device (7, 8) extends at least partly across the heater from an edge of the heater and over the at least one heating element (3). The surface of the base (2) is provided with a shallow recess (9) beneath the rod-like temperature-responsive device (7, 8) and the ribbon (4) is partially embedded in the shallow recess (9) to a lesser extent than in the surface of the base (2) at either side of the shallow recess.

9 Claims, 1 Drawing Sheet

RADIANT ELECTRIC HEATER

This invention relates to radiant electric heaters, particularly but not exclusively for use in cooking appliances behind a sheet of a material such as glass-ceramic. In particular, the sheet of material such as glass-ceramic may be a cooking surface.

BACKGROUND TO THE INVENTION

Radiant electric heaters are well known for use behind glass-ceramic cooking surfaces. Such heaters can comprise a dish-like support having therein a base layer of insulation material, such as microporous thermal and electrical insulation material. At least one electrical heating element is provided, supported on the surface of the base layer. One form of heating element which has found wide acceptance is an elongate electrically conductive ribbon which is supported on edge and partially embedded in the surface of the base layer.

DESCRIPTION OF PRIOR ART

It is known to provide a temperature-responsive device of rod-like form extending at least partly across the heater from an edge thereof and overlying the heating element or elements. Such temperature-responsive device operates to control the operation of the heater, such as to prevent the glass-ceramic material of the cooking surface reaching a high temperature at which damage would occur thereto.

It is important that the temperature-responsive device should primarily respond to the temperature of the cooking surface rather than to direct thermal radiation from the heating element or elements. It is known to reduce the direct thermal radiation from the heating element or elements on the temperature-responsive device by arranging for a strip of the surface of the base layer directly beneath the device to be free from the heating element or elements. This is achievable when it is possible to provide the heating element or elements in a pattern whereby suitable reversals are arranged in the pattern such that there is no traversal of the element or elements beneath the temperature-responsive device.

However there are situations where this cannot be achieved. One in particular is where at least one heating element is provided configured as a spiral, which may be a double spiral. With such an arrangement it is unavoidable that passage of the element or elements occurs beneath the temperature-responsive device. This means that the full radiation power of the heating element or elements is directly incident on the temperature-responsive device and furthermore the heating element or elements reach a locally higher temperature directly beneath the temperature-responsive device compared with other regions of the heater. This may cause premature failure of the element or elements as well as premature switching of the limiter.

OBJECT OF THE INVENTION

It is an object of the present invention to overcome or reduce these problems.

SUMMARY OF THE INVENTION

According to the present invention there is provided a radiant electric heater comprising a base of thermal and electrical insulation material having a surface supporting at least one heating element in the form of an elongate electrically conductive ribbon, the ribbon being supported on edge and partially embedded in the surface of the base, and a rod-like temperature-responsive device extending at least partly across the heater from an edge thereof and over the at least one heating element, wherein the surface of the base is provided with a shallow recess beneath the rod-like temperature-responsive device, and wherein the ribbon is partially embedded in the shallow recess to a lesser extent than in the surface of the base at either side of the shallow recess.

As a result of the invention, the at least one heating element operates at a reduced temperature beneath the rod-like temperature-responsive device thus avoiding premature failure of the element or elements and also providing a correspondingly reduced direct thermal influence on the device.

The at least one heating element where partially embedded in the shallow recess may present an upper surface plane which is substantially coplanar with an upper surface plane presented by the at least one heating element at either side of the shallow recess.

The shallow recess may be substantially in the form of a channel.

The base may comprise microporous thermal and electrical insulation material.

The at least one heating element may be generally in the form of a spiral which may be a double spiral.

The at least one heating element in the form of the elongate electrically conductive ribbon may incorporate a plurality of spaced-apart support members, such as legs which may be integral with the remainder of the ribbon, extending edgewise from the remainder of the ribbon and being at least partially embedded in the surface of the base.

For a better understanding of the present invention and to show more clearly how it may be put into effect reference will now be made, by way of example, to the accompanying drawings in which:

DESCRIPTION OF PREFERRED EMBODIMENT

Figure 1:
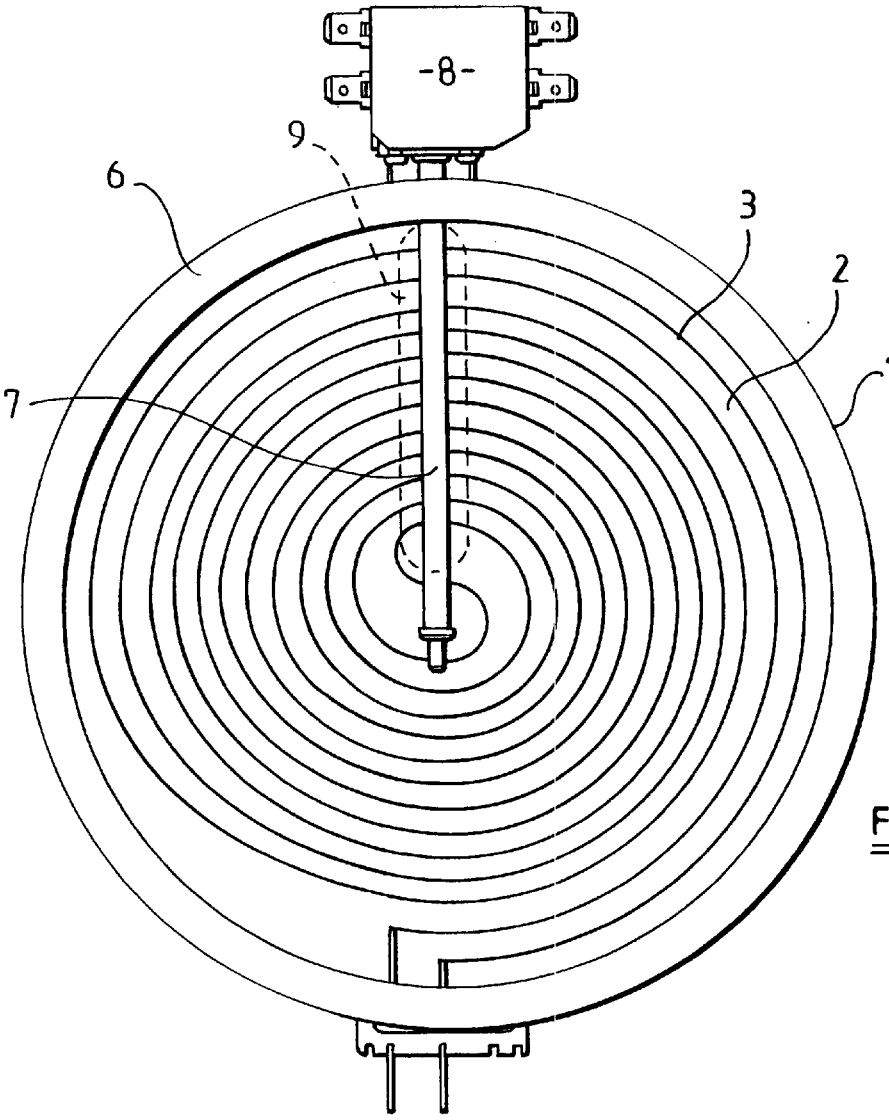
FIG. 1 is a plan view of a radiant electric heater according to the invention.
Figure 2:
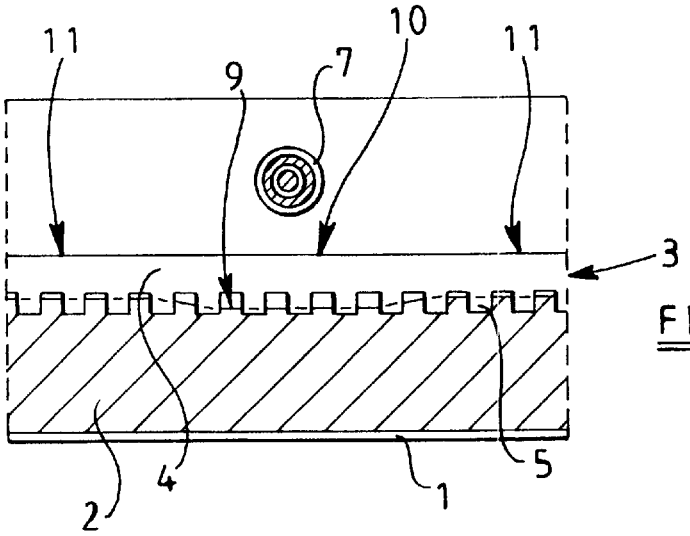
FIG. 2 is a cross-sectional view of part of the heater of FIG. 1.

A radiant electric heater comprises a metal dish 1 having provided therein a base layer 2 of thermal and electrical insulation material, preferably microporous thermal and electrical insulation material. A radiant electric heating element 3 is provided comprising a corrugated ribbon 4, such as of iron-chromium-aluminium alloy, incorporating spaced-apart legs 5 integral therewith and extending edgewise therefrom. Alternatively, the ribbon may incorporate separate legs which are secured to the remainder of the ribbon. The heating element is mounted edgewise on the base layer 2 and secured by partial embedding in the surface of the base layer 2. This is achieved by pressing the legs 5 on the corrugated ribbon 4 at least partly into the surface of the base layer 2, the technique being known in the art. As shown, the heating element is of double spiral form, but may be of another suitable form.

A peripheral wall 6 of insulation material is provided in the heater and has a top surface which may be arranged to contact the rear side of a glass-ceramic cooking surface (not shown) in a cooking appliance.

A temperature limiter of well known form is provided on the heater and comprises a rod 7 extending over the heating element and operating a switch arrangement 8 at the edge of the heater. Such temperature limiter is operable at a predetermined temperature to de-energise the heating element to prevent overheating particularly of a glass-ceramic cooking surface when the heater is operated therewith.

In the absence of the present invention the heating element 3, where it passes beneath the rod 7 of the temperature limiter, operates at a locally higher temperature than the remainder of the element and this, coupled with the close proximity of the element 3 to the rod 7, results in premature failure of the element and also premature switching of the temperature limiter.

In the present invention this disadvantage is minimised or reduced by providing a shallow recess 9 in the surface of the base layer 2 directly beneath the rod 7 of the temperature limiter. The shallow recess 9 is substantially in the form of a channel having a depth of, for example, 1 to 2 mm. Where the heating element 3 crosses the shallow recess 9, the legs 5 on the corrugated ribbon 4 are embedded in the base layer 2 to a lesser extent than are those legs on the ribbon at either side of the shallow recess 9. For example, where the heating element crosses the shallow recess the legs 5 may be embedded to a depth of about 1 mm whereas elsewhere they may be embedded to a depth of about 2 mm. This arrangement does not alter the overall profile of the heating element, since the element where partially embedded in the shallow recess presents an upper surface plane 10 which is substantially coplanar with an upper surface plane 11 presented by the heating element at either side of the shallow recess 9.

As a result of the arrangement, the heating element has a greater exposed surface area and consequently a reduced temperature where it crosses the shallow recess 9 in the base layer 2 directly beneath the rod 7 of the temperature limiter. This advantageously prevents premature failure of the heating element 3 and also reduces the direct influence of the heating element on the rod 7 of the temperature limiter.

I claim:

1. A radiant electric heater comprising a base of thermal and electrical insulation material having a surface supporting at least one heating element in the form of an elongate electrically conductive ribbon, the ribbon being supported on edge and partially embedded in the surface of the base, and a rod-like temperature-responsive device extending at least partly across the heater from an edge thereof and over the at least one heating element, wherein the surface of the base is provided with a shallow recess beneath the rod-like temperature-responsive device, the ribbon being partially embedded in the shallow recess to a lesser extent than in the surface of the base at either side of the shallow recess.

2. A heater according to claim 1, wherein the at least one heating element, where partially embedded in the shallow recess, presents an upper surface plane which is substantially coplanar with an upper surface plane presented by the at least one heating element at either side of the shallow recess.

3. A heater according to claim 1, wherein the shallow recess is substantially in the form of a channel.

4. A heater according to claim 1, wherein the base comprises microporous thermal and electrical insulation material.

5. A heater according to claim 1, wherein the at least one heating element is generally in the form of a spiral.

6. A heater according to claim 5, wherein the spiral comprises a double spiral.

7. A heater according to claim 1, wherein the at least one heating element in the form of the elongate electrically conductive ribbon incorporates a plurality of spaced-apart support members extending edgewise from the remainder of the ribbon and being at least partially embedded in the surface of the base.

8. A heater according to claim 7, wherein the spaced-apart support members comprise legs.

9. A heater according to claim 8, wherein the legs are integral with the ribbon.

* * * * *